United States Patent [19]

Jensen

[11] Patent Number: 5,023,519

[45] Date of Patent: Jun. 11, 1991

[54] CIRCUIT FOR STARTING AND OPERATING A GAS DISCHARGE LAMP

[76] Inventor: Kaj Jensen, Kaerparken, 4, DK-2800 Lyngby, Denmark

[21] Appl. No.: 165,104

[22] PCT Filed: Jul. 16, 1987

[86] PCT No.: PCT/DK87/00092

§ 371 Date: May 16, 1988

§ 102(e) Date: May 16, 1988

[87] PCT Pub. No.: WO88/00788

PCT Pub. Date: Jan. 28, 1988

[30] Foreign Application Priority Data

Jul. 16, 1986 [DK] Denmark ..... 3395/86

[51] Int. Cl.[5] ..... H05B 41/24; H05B 41/36

[52] U.S. Cl. ..... 315/242; 315/219; 315/223; 315/226; 315/243; 315/DIG. 2; 315/DIG. 5

[58] Field of Search ..... 315/241 R, 242, 243, 315/244, DIG. 25, 307, 226, 219, 223

[56] References Cited

U.S. PATENT DOCUMENTS 4,388,562 6/1983 Josephson ..... 315/195 X 4,701,673 10/1987 Lagree et al. ..... 315/242 X

FOREIGN PATENT DOCUMENTS 0057616 8/1982 European Pat. Off. .

*Primary Examiner*—David Mis

[57] ABSTRACT

A circuit is disclosed which is capable of positively shifting a gas discharge lamp from its off-state to its on-state without emitting light flashes and further positively maintains the gas discharge lamp in its on-state when first ignited. The circuit contains an oscillator device which generates and supplies an oscillator signal of a specific oscillator frequency from two output terminals of the oscillator device. It also contains a current limiting device an a parallel-resonance circuit comprising a capacitor and an inductor. The parallel resonance circuit has a frequency of resonance substantially identical to the oscillator frequency. The current limiting device and parallel-resonance circuit are connected in a series configuration across the output terminals of the oscillator device. Further, the gas discharge lamp is connected across or in parallel with the parallel-resonance circuit. The current limiting device preferably constitutes an inductor of a series-resonance circuit, the resonance frequency of which is lower than the oscillator frequency of the oscillator device. The oscillator device is preferably tuned to the frequency of resonance of the parallel-resonance circuit.

22 Claims, 4 Drawing Sheets

Figure 1:
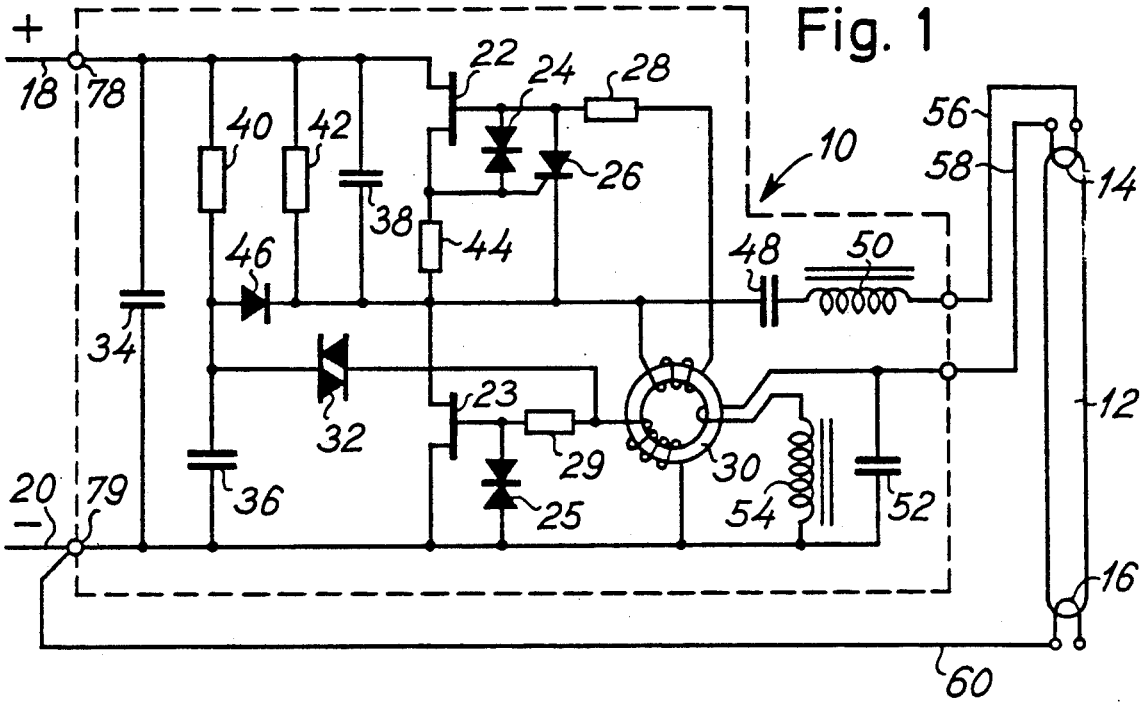

Fig. 4
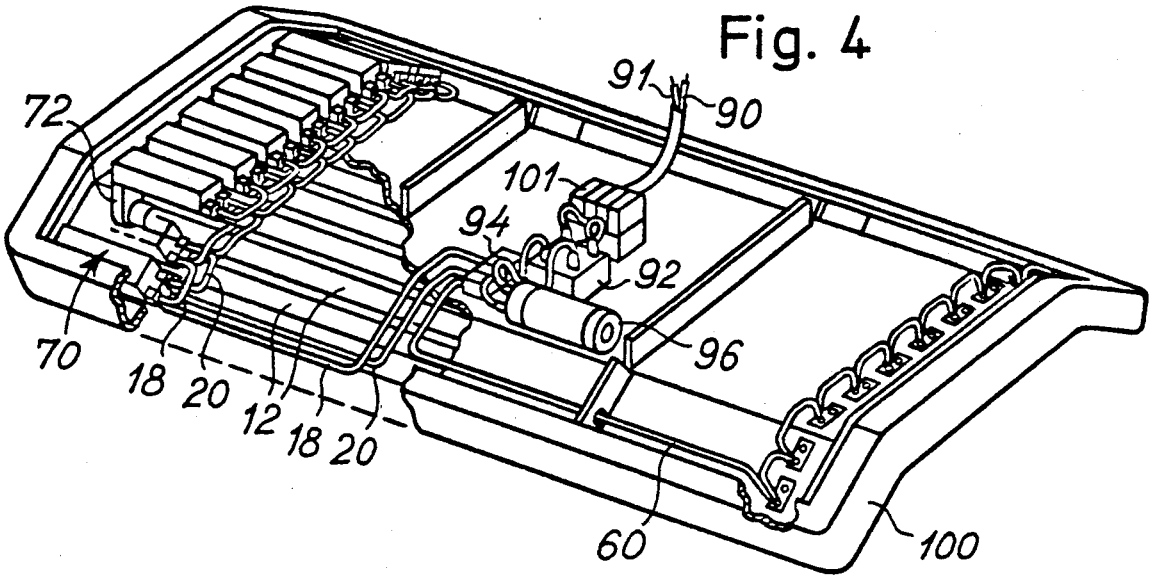
Fig. 5a
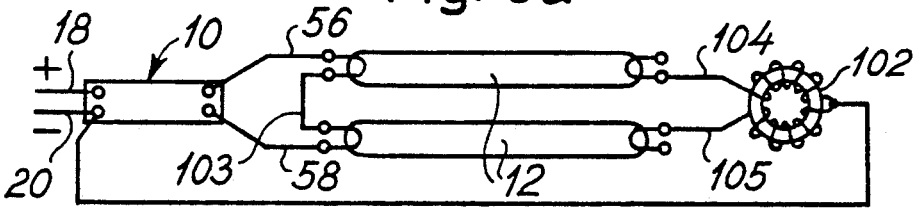
Fig. 5b
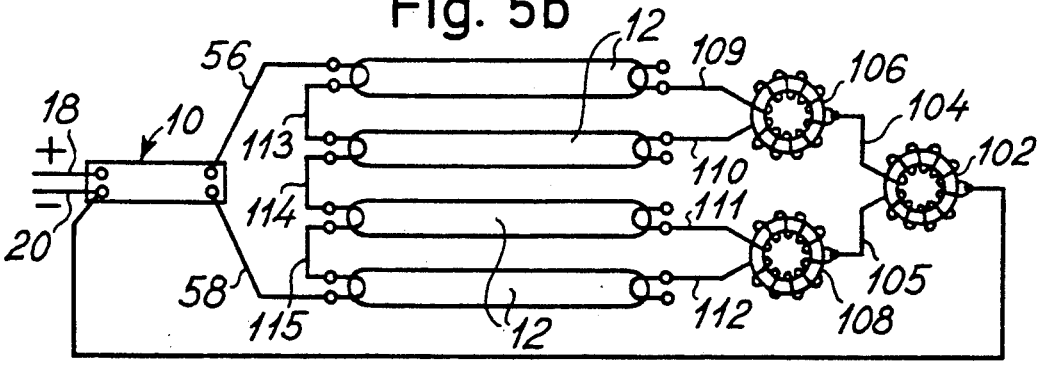
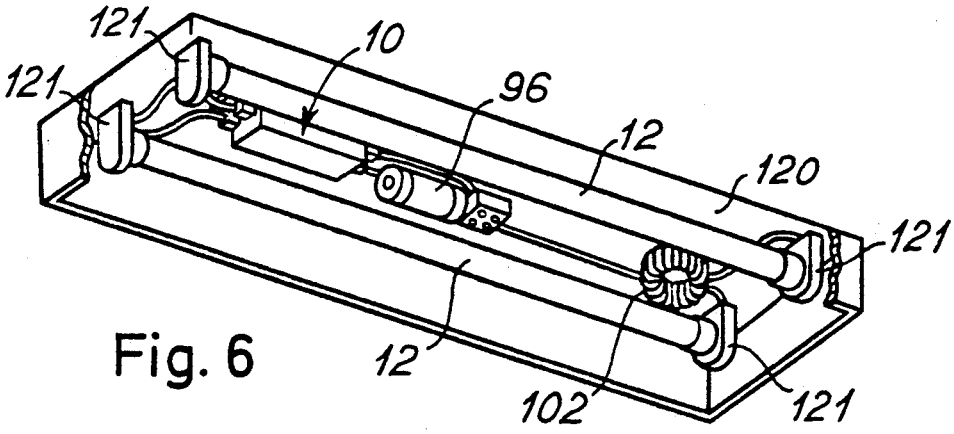
Fig. 6

Fig. 7
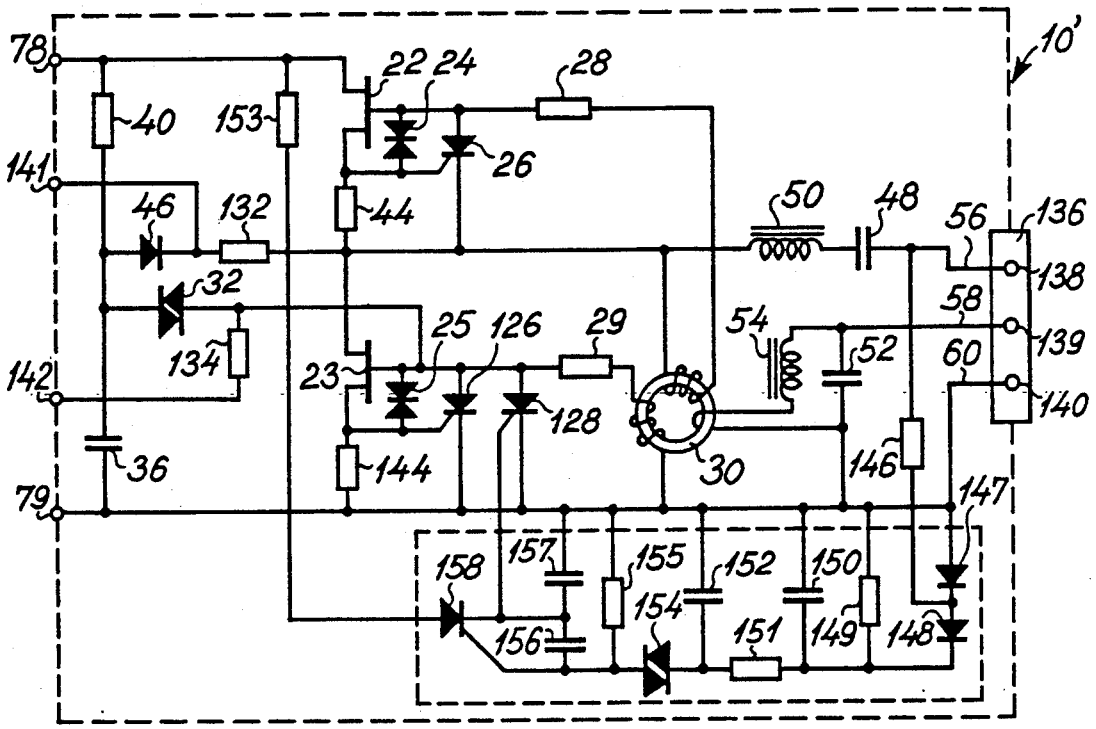
Fig. 8
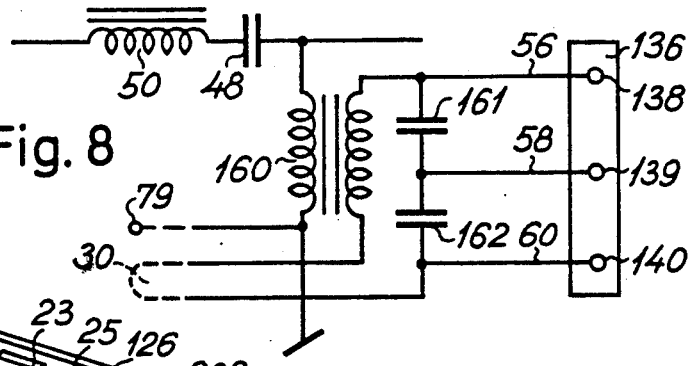
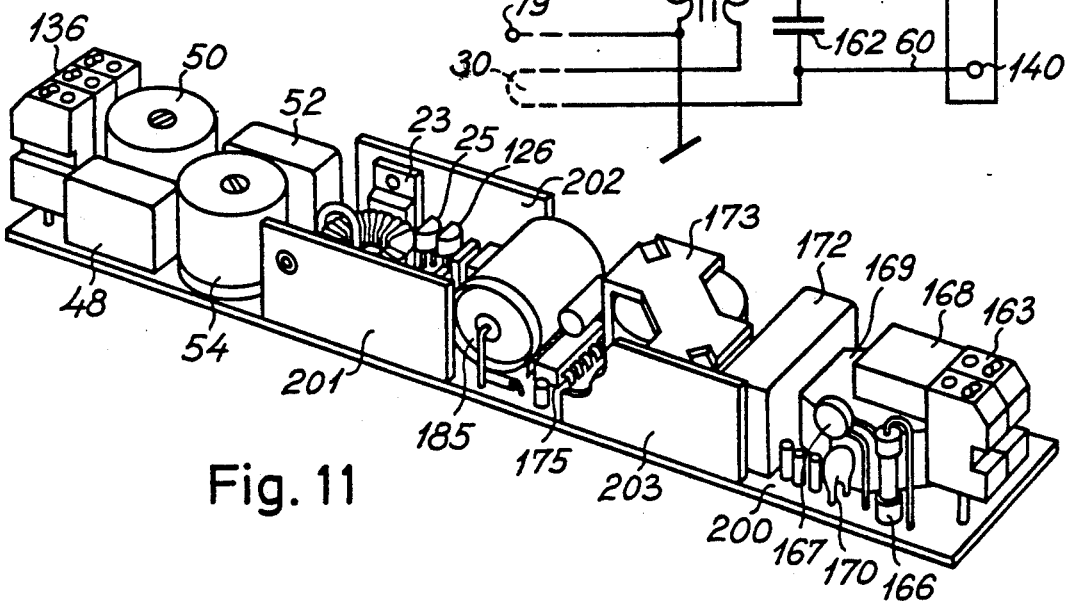
Fig. 11

Fig. 9
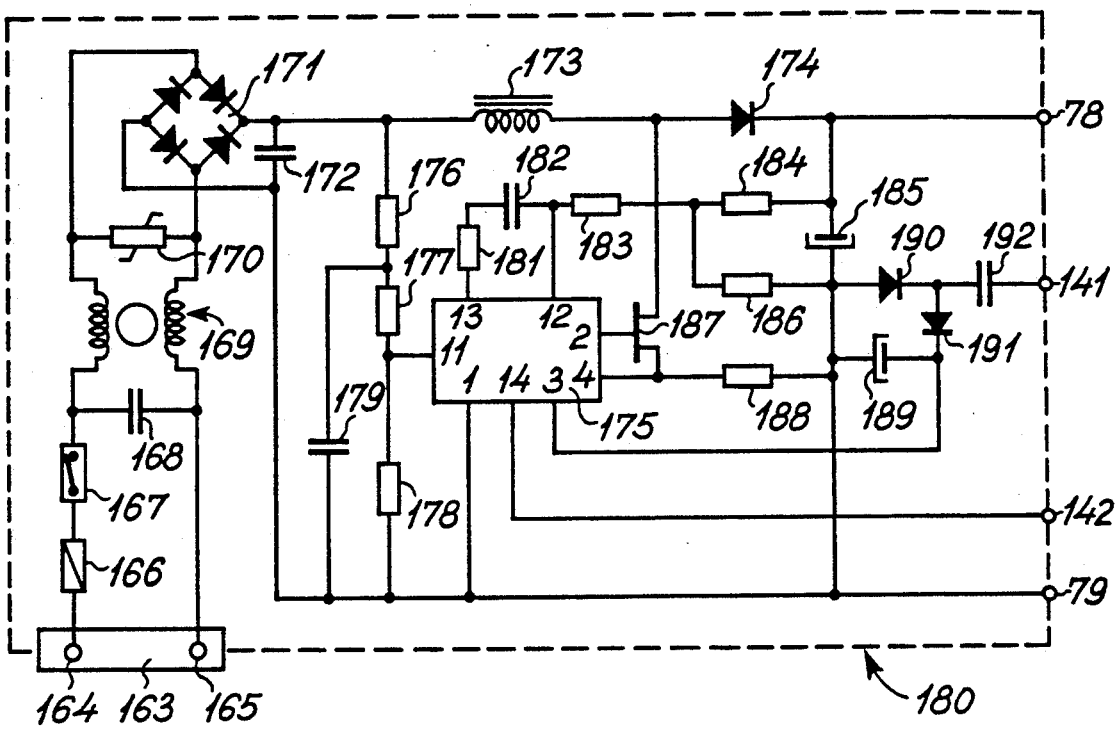
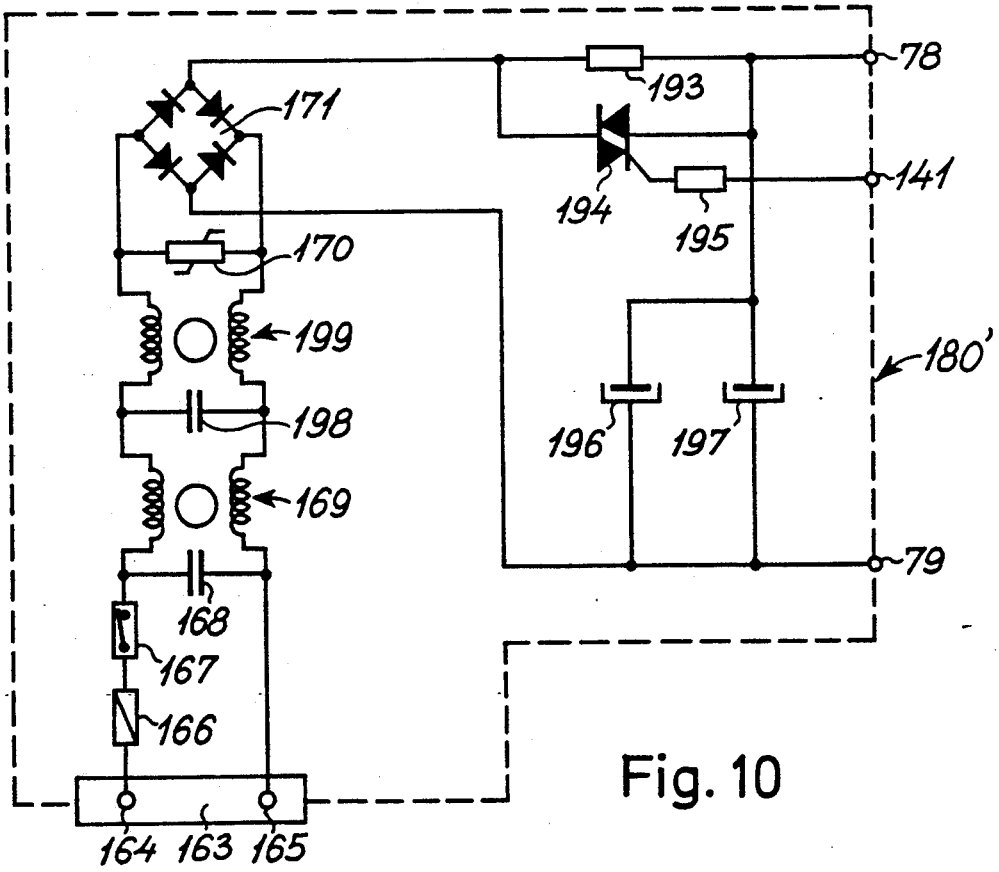
Fig. 10

CIRCUIT FOR STARTING AND OPERATING A GAS DISCHARGE LAMP

The present invention relates to a circuit for starting and operating a gas discharge lamp.

A gas discharge lamp is a lamp, which emits light in an electric discharge in the gas of the gas discharge lamp. In the present context, the term "gas discharge lamp" is a generic term comprising all lamps different from incandescent lamps, such as conventional gas discharge lamps, fluorescent lamps, halide lamps and arc lamps.

Common to all gas discharge lamps is the distinct shift in the characteristic of the gas discharge lamp, when the lamp is shifted from its off-state to its on-state and further the requirement of the gas discharge lamp of exceeding a threshold of electric energy supply for switching the gas discharge lamp from its off-state to its on-state. In its off-state, the gas discharge lamp represents a high electric impedance, whereas in its on-state the gas discharge lamp represents a basically resistive load or is to be considered equivalent to a resistance of finite value. Since the electric resistance represented by the gas discharge lamp in its on-state is a decreasing function of the RMS (root mean square) current supplied to the lamp, the lamp has to be connected with a ballast impedance in series with the lamp itself in order to limit the current supply to the lamp when the lamp is in its on-state on a constant voltage supply such as a mains supply. From the above, it is further understood that a starting circuit has to be provided in order to supply sufficient energy in excess of the above mentioned threshold for shifting the gas discharge lamp form its off-state to its on-state.

A plurality of ballast and starter circuit configurations of passive and active circuit configurations are known in the art. Common to the passive circuit configurations of the ballast and starter circuits is the well-known ignition problem resulting in the emission of light flashes prior to the shift of the gas discharge lamps from their off-state to their on-state, as the passive circuit configurations are not able to positively shift the gas discharge lamps from their off-state to their on-state, and the unstable emission of light from the gas discharge lamps often perceived as a constant flickering of the light emitted. The active circuit configurations of the ballast and starter circuit known in the art are stated to eliminate the above starting and light flickering problems. However, the active circuit configurations known hitherto, have gained little commercial success. First this is because highly elaborate circuit configurations are expensive as compared to more simple passive circuit configurations. Second, it is because stability problems, e.g. when a burnt out gas discharge lamp is connected to the circuit, may result in excessive current being drawn from the circuit resulting in the destruction of the active high power components of the circuit.

Therefore, there is a need for a circuit for starting and operating a gas discharge lamp in which the circuit on the one hand eliminates the problems associated with the passive circuit configurations, i.e. which is capable of positively shifting the gas discharge lamp from its off-state to its on-state without emitting light flashes. One is further needed, which, hand, is of a fairly simple configuration as compared to the active configurations known hitherto. Finally, one is needed which positively limits the current or power supplied from the active power supply components of the circuit when the circuit is connected to a low impedance load such as a burnt out gas discharge lamp or a defective gas discharge lamp. The above object is obtained by a circuit according to the present invention for starting and operating a gas discharge lamp, comprising:

- an oscillator means for generating and supplying an oscillator signal of a specific oscillator frequency across two output terminals of said oscillator means,
- a current limiting device, and
- a parallel-resonance circuit comprising a capacitor and an inductor and having a frequency of resonance substantially identical to said oscillator frequency, said current limiting device and said parallel-resonance circuit being connected in a series configuration across said output terminals, and said gas discharge lamp being connected across said parallel-resonance circuit.

The circuit of the present invention is based on the realization that the gas discharge lamp may be started and operated from a parallel-resonance circuit, which is connected in parallel with the gas discharge lamp, and which is supplied with energy from the oscillator means of the circuit through a current limiting device. Consequently, when the gas discharge lamp is in its off-state, and accumulates energy, and when the energy accumulated in the parallel-resonance circuit exceeds the threshold energy for igniting or starting the gas discharge lamp, it supplies a high energy current to the gas discharge lamp as the current limiting device limits the current supplied from the parallel-resonance circuit to the oscillator means and consequently protects the oscillator means from the high energy current.

Apart from fulfilling the above objects of the present invention, the circuit of the present invention further offers the distinct advantage as compared to commercially available electronic ballast and starter circuits, in that it is capable of positively starting even large or long fluorescence tubes. This is not possible with known and commercially available electronic ballast and starter circuits, which are most often not capable of igniting or starting the fluorescence tube but only capable of making the tube fluorescent at the ends thereof.

In accordance with the presently preferred embodiment of the circuit according to the invention, the current limiting device is constituted by a further inductor, and the circuit further comprises a further capacitor connected in series with said further inductor. Together with the further inductor, it constitutes a series-resonance circuit. The series-resonance circuit has a resonance frequency lower than the oscillator frequency. Since the frequency of resonance of the series-resonance circuit is lower than the oscillator frequency and consequently lower than the frequency of resonance of the parallel-resonance circuit, the oscillator signal supplied from the oscillator means is filtered by the series-resonance circuit, thereby attenuating higher order harmonics. Therefore, a basically sinusoidal signal is supplied to the parallel-resonance circuit and further, provided the gas discharge lamp has been started, supplied to the gas discharge lamp. This constitutes a basic resistive load, and which further constitutes an aerial, from which the oscillator signal supplied to the gas discharge lamp is radiated. By filtering the oscillator signal and by supplying the sinusoidal signal to the gas discharge lamp, the emission of radio frequency signals, which constitute noise signals in the radio frequency spectrum, is to a great extent attenuated or substantially eliminated. The tuning of the series-resonance circuit to a frequency of resonance lower than the frequency of resonance of the parallel-resonance circuit further provides a varying transformer phase difference between the series- and parallel-resonance circuits. It also the accumulation of energy in the parallel-resonance circuit, when the gas discharge lamp has not yet been started so as to generate a very high starter voltage in the parallel-resonance circuit for starting the gas discharge lamp. Due to the current limiting capability of the inductor of the series-resonance circuit or of the current limiting device, the high voltage signal is, as described above, supplied to the gas discharge lamp. This occurs has not yet been started, without any substantial energy being re-transferred or re-transmitted to the oscillator means through the series-resonance circuit. The gas discharge lamp is consequently positively started.

It is to be underlined that the voltage generated by the parallel-resonance circuit, when the energy is accumulated in the parallel-resonance circuit, is limited by the Q-factor of the parallel-resonance circuit exclusively. Further, provided the Q-factor is sufficiently high, a starter voltage in excess of the threshold voltage required to start the gas discharge lamp may be generated by the parallel-resonance circuit. However, the gas discharge lamp is normally started at a voltage far lower than the maximum voltage which may be generated by the parallel-resonance circuit. This means that the starting of the gas discharge lamp, and more specifically the starting of gas discharge lamps of different characteristics, viz. of different start voltages, is always positively affected by the circuit of the present invention.

It has further been realized that the series configuration of the series-resonance circuit and parallel-resonance circuit, across which the gas discharge lamp is connected, provides a substantially constant supply of energy to the gas discharge lamp independent of the operational characteristic of the gas discharge lamp, e.g. expressed in terms of the voltage of operation of the gas discharge lamp. This may be altered and, normally will be increased, as the working time or operational time of the gas discharge lamp increases. The substantially constant supply of energy to the gas discharge lamp, when the gas discharge lamp is operating, further makes the operation of the gas discharge lamp independent of the voltage of the oscillator signal generated by the oscillator means and further independent of the supply voltage supplied to the oscillator means, e.g. from a rectifier means. This will be described below, with the rectifier means further being connected to a mains supply.

The circuit of the present invention may, as mentioned above, be employed for starting and operating any gas discharge lamps, such as fluorescent lamps or tubes, halide lamps, arc lamps, etc. A highly important application of the circuit of the present invention is the starting and the operation of conventional fluorescence tubes, which include starting electrodes further constituting the terminals of the tubes. In this highly relevant application of the circuit according to the invention, the series-resonance circuit and the parallel-resonance circuit may be connected to each other in said series configuration through a starting electrode of the gas discharge lamp. By connecting the resonance circuits to each other through the starting electrode, two important advantages are achieved. First, in the starting phase the current supplied from the series-resonance circuit to the parallel-resonance circuit heats the starting electrode. This promotes the starting or ignition of the gas discharge lamp. It is, however, to be underlined that the supply of current to the starting electrode is not mandatory to the positive starting of the gas discharge lamp by means of the circuit of the present invention. Second, the connection between the series-resonance circuit and the parallel-resonance circuit is interrupted when the gas discharge lamp is removed, e.g. for service or replacement. When the gas discharge lamp is removed and the connection between the series-resonance circuit and the parallel-resonance circuit is interrupted, the accumulation of energy in the parallel-resonance circuit is also interrupted. Thus, when the gas discharge lamp is removed and the connection between the series-resonance circuit and the parallel-resonance circuit is interrupted, the extremely high starting voltage characteristic of the parallel-resonance circuit of the circuit of the present invention is not generated. This is of the utmost importance from a safety point of view, as the accumulation of energy in the parallel-resonance circuit might be of great danger to a person replacing or rearranging the gas discharge lamp.

In accordance with a further or alternative embodiment of the circuit of the present invention, which further reduces the risk of exposing a person replacing or rearranging the gas discharge lamp to electric shock, the series-resonance circuit and the parallel-resonance circuit are connected to each other in said series configuration through a transformer. A primary winding of the transformer is connected in series with the series-resonance circuit across the two output terminals of the oscillator means, and a secondary winding of the transformer is connected in parallel with the capacitor of the parallel-resonance circuit so as to constitute the inductor of the parallel-resonance circuit.

The oscillator means of the circuit according to the invention may be constituted by, for example, a full-bridge oscillator circuit or, preferably, by a half-bridge oscillator circuit. The output terminals of the oscillator means are constituted by a hot terminal and a cold terminal, and the cold terminal further constitutes a ground terminal of the entire circuit. The oscillator signal is then supplied from the hot terminal to the series-resonance circuit of the series configuration of the series-resonance circuit and the parallel-resonance circuit.

The oscillator means may further be an autonomous operating oscillator means, such as a clock controlled oscillator. This supplies the oscillator signal to the series-configuration of the series-resonance circuit and the parallel-resonance circuit controlled by the clock or controlled by any other oscillator controlling means. In this autonomous oscillator means embodiment, the parallel-resonance circuit has, however, to be accurately tuned to the frequency of oscillation, which is determined internally or externally of the oscillator means. However, the oscillator means is preferably supplied with a feed-back oscillator signal for controlling the generation of the oscillator signal. The feed-back oscillator signal is generated by the parallel-resonance circuit to ensure that the oscillator means is tuned to the frequency of resonance of the parallel-resonance circuit, which makes the tuning of the parallel-resonance circuit far less critical and further provides a compensation for temperature variations or temperature drifts, due to e.g. heating or cooling of the capacitor or the inductor of the parallel-resonance circuit.

The feed-back oscillator signal generated in any appropriate manner by the parallel-resonance circuit may be derived from the current or voltage oscillating in the parallel-resonance circuit, e.g. from the inductor or from the capacitor or from parts thereof. Further, it may preferably be generated by a transformer having a primary winding and a secondary winding, the primary winding connecting the capacitor and the inductor of the parallel-resonance circuit, and the secondary winding being connected to the oscillator means for supplying the feed-back oscillator signal to the oscillator means.

The half-bridge oscillator preferably constituting the oscillator means of the circuit according to the invention may be implemented in any appropriate manner, e.g. comprising valves, coupling transformers, etc. However, the half-bridge oscillator preferably comprises solid state switches, such as planar transistors, thyristors, or still more preferably power MOS-FETs. The half-bridge oscillator comprises at least two solid state switches each having a control terminal, and the above described transformer generating the feed-back oscillator signal, preferably also comprises two identical secondary windings. The control terminals of the two solid state switches are connected to a respective secondary winding of the transformer for receiving the feed-back oscillator signal so as to control the switches in a push-pull operation.

The oscillator means, the oscillator frequency of which is preferably tuned to the frequency of resonance of the parallel-resonance circuit, may be controlled into generating and supplying an oscillator signal having any appropriate waveform, e.g. a sinusoidal waveform, a triangular waveform or preferably a square-waveform. For controlling the oscillator means into generating the square-wave oscillator signal, the control terminals of the solid state switches may be connected to its respective secondary winding of the feed-back oscillator signal generating transformer through a peak-limiting circuit so as to peak-limit the feed-back oscillator signal supplied to the control terminals of the solid state switches. The solid state switches are consequently operated in an alternating on/off operational mode resulting in the generation of a square-wave oscillator signal. It is, however, to be mentioned that the controlling of the solid state switches by means of a single transformer having separate secondary windings connected to the respective control terminals of the solid state switches results in a soft shifting of the solid state switches so that the solid state switches are never turned on at the same time. This overshoot or ringing of the oscillator signal waveform, as this might otherwise result in an excessive current being supplied or drawn from one or more of the solid state switches. This might further result in the destruction of one or more solid state switches and in the destruction of the entire circuit, if not previously eliminated.

The circuit, according to the invention, receives power from a DC power supply, which may be an internal or an external DC power supply. In accordance with the presently preferred embodiment of the circuit according to the invention, the oscillator means of the circuit comprises two input terminals to be connected to a DC power supply constituting an external DC power supply for receiving a DC signal from the DC power supply. As mentioned above, the circuit according to the invention may be supplied from a mains supply, and the circuit may consequently further comprises or be connected to, the mains supply through a rectifier means. This generates the DC power supply signal for the oscillator means of the circuit.

In a further embodiment of the circuit according to the invention, the DC power supply is constituted by a switch-mode power supply. However, the DC power supply may alternatively be constituted by any appropriate DC power supply means, such as an accumulator means, e.g. a rechargeable accumulator means including a recharging device or circuit and one or more rechargeable accumulators, an unstabilized DC power supply including a rectifier and a smoothing capacitor or a stabilized DC power supply including a rectifier, a smoothing capacitor and a stabilizing circuit well-known in the art per se. The DC power supply preferably further comprises a filtering means for reducing or eliminating highly reactive loading of the mains supply in order to reduce the deformation of the sinusoidal wave form of the mains supply voltage due to non-resistive loading of the mains supply. The filtering means may be constituted by a conventional mains noise rejection filter.

In order to further reduce the risk of exposing a person replacing or rearranging the gas discharge lamp to even minor electric shocks which might confuse the person and in certain replacement or rearranging situations be of a great risk to the person, e.g. when the person is carrying out a rearranging or replacement from a tall ladder, the circuit preferably further comprises a shut-down circuit connected across the gas discharge lamp detecting if the voltage supplied to the gas discharge lamp exceeds a predetermined threshold for a period of time, exceeding a predetermined period of time. It then disables the circuit for starting and operating the gas discharge lamp in case the voltage exceeds the threshold for a period of time exceeding the predetermined period of time.

A particular feature of the circuit according to the invention is the extremely simple mounting procedure to be carried out when a plurality of circuits according to the invention are arranged or mounted in a lighting fitting or luminaire with a plurality of gas discharge lamps connected to a respective circuit for starting and operating the gas discharge lamps.

In the above described presently preferred embodiment of the circuit according to the invention, the oscillator means is constituted by a half-bridge oscillator having a cold terminal, which constitutes a ground terminal of the circuit. The cold terminals or ground terminals of the individual circuits may consequently be constituted by a common ground terminal from which a single wire connection is to be established to one terminal of each of the gas discharge lamps. The gas discharge lamps are further connected to the respective circuits through one or two wire connections to a different terminal of a gas discharge lamp in question or to the starting electrode of the gas discharge lamp in question.

The present invention also relates to a plurality of circuits according to the invention, which are further connected to a plurality of gas discharge lamps in accordance with the above described extremely simple wiring procedure. The plurality of circuits consequently comprises a further plurality of gas discharge lamps being connected to a respective circuit of said plurality of circuits. The ground terminal of each of the circuits of the plurality of circuits are constituted by a single ground terminal, and each of the plurality of gas discharge lamps is connected to the single ground terminal.

The present invention also relates to a balancing transformer for connecting at least a first and a second gas discharge lamp of a first and second rating, respectively, in parallel with a common circuit for starting and operating the gas discharge lamps. The circuit is of a rating substantially identical to the sum or ratings of the first. It further contains second gas discharge lamps, a first end of each of the gas discharge lamps being connected to a terminal of said circuit, the balancing transformer comprising:

a core, and a first and a second winding, said first and second windings being arranged on said core, a first end of each of said windings being connected to a common terminal of said common circuit and a second end of each of said windings being connected to a second end of each of said gas discharge lamps, said windings further being arranged on said core so as to generate a resulting magnetic field of substantially zero intensity in said core when said gas discharge lamps are both operating.

Figure 2:
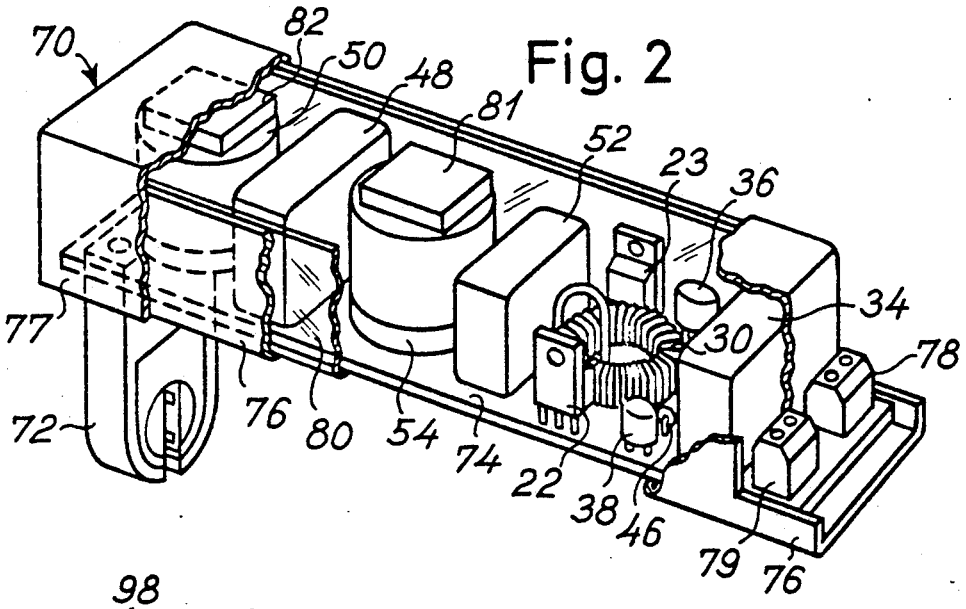
Figure 3:
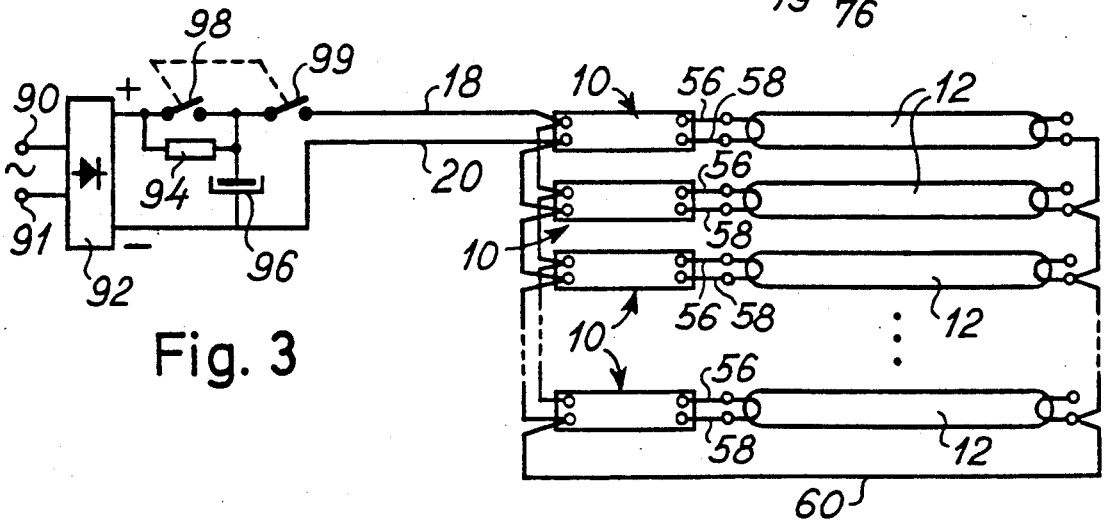

The invention will now be further described with reference to the drawings, in which FIG. 1 is a schematical view of a presently preferred embodiment of a circuit for starting and operating a gas discharge lamp according to the invention, connected to a gas discharge lamp constituted by a fluorescent tube, FIG. 2 is a perspective view of a housing containing a circuit board comprising the circuit shown in FIG. 1, FIG. 3 is a schematical view of a plurality of circuits according to the invention connected to respective gas discharge lamps and to a common DC power supply illustrating the extremely simple wiring of the circuit and the gas discharge lamps by employing the circuit according to the invention, FIG. 4 is a perspective view of a lightning fitting or luminaire comprising a plurality of circuits and corresponding gas discharge lamps interconnected in accordance with the wiring shown in FIG. 3, FIGS. 5*a* and 5*b* are schematical views of the wiring of a circuit according to the invention to two and four gas discharge lamps, respectively, FIG. 6 is a perspective view of a lightning fitting or luminaire including a circuit according to the invention and two gas discharge lamps interconnected in accordance with the wiring of FIG. 5*a*., FIG. 7 is a schematical view of a slightly modified embodiment of the circuit for starting and operating the gas discharge lamp shown in FIG. 1, FIG. 8 a schematical view of an alternative part of the circuit shown in FIG. 7 which alternative part includes a transformer, FIG. 9 a schematical view of a switch-mode DC power supply for the circuit shown in FIG. 7, FIG. 10 a schematical view of an alternative DC power supply for the circuit shown in FIG. 7, and FIG. 11 a perspective view similar to the perspective view of FIG. 2 of the circuit shown in FIG. 7 and the switch-mode DC power supply shown in FIG. 9 arranged on a common printed circuit board to be arranged in a common housing, not shown in FIG. 11.

In FIG. 1, a presently preferred embodiment of a circuit for starting and operating a gas discharge lamp, such as a flourescence tube, is shown. The circuit is contained within a dotted-line boundary and is designated by the reference numeral 10 in its entirety. The gas discharge lamp is designated the reference numeral 12 and contains two conventional starting electrodes 14 and 16 arranged at opposite ends of the tube. The electronic circuit 10 receives electric power from an external DC power supply through power supply rails 18 and 20 and further through power supply input terminals 78 and 79, respectively. The electrode 16 of the gas discharge lamp 12 is connected to the input terminal 79 through a wire 60. The electronic circuit is basically a combination of a half-bridge oscillator and a series connection of a series-resonance circuit and a parallel-resonance circuit.

The series-resonance circuit is constituted by a capacitor 48 and an inductor 50, and the parallel-resonance circuit is constituted by a capacitor 52 and an inductor 54. As is evident from FIG. 1, the series-connection between the series-resonance circuit 48, 50 and the parallel-resonance circuit 52, 54 is established through two wires 56 and 58 and further through the starting electrode 14 of the gas discharge lamp or luminescence tube 12. The capacitor 52 and the inductor 54 of the parallel-resonance circuit are further connected to each other through a primary winding of a feed-back transformer 30, which includes two secondary windings which are connected to a respective part of the oscillator. Centrally, the oscillator comprises two power MOS-FET switches 22 and 23, which are connected to the respective feed-back winding of the transformer 30 through resistors 28 and 29, respectively. The voltages supplied to the gates of the power MOS-FET switches 22 and 23 from the feed-back transformer 30 are peak-limited by peak-limiting devices 24 and 25. These are constituted by a component known as a "transil" and comprise a series connection of two zener diodes, which are connected to each other "back-to-back", i.e. connected to each other through the anodes or, alternatively, the cathodes of the zener diodes. The power MOS-FET switch 22 is further connected to a current limiting circuit constituted by a resistor 44 and a thryristor 26. The oscillator, the oscillation of which is controlled by the feed-back transformer 30 and further tuned to the frequency of resonance of the parallel-resonance circuit 52, 54 is initially started by a diac 32, a capacitor 36, which is initially charged and a diode 46. This serves the purpose of blocking the diac after the initial firing of the diac and two resistors 40 and 42. The transformer 30 detects any current flowing in the parallel-resonance circuit 52, 54 and shifts the transistors 22 and 23 from their off-state to their on-state in an alternating push-pull mode and further in a mode controlled by the peak-limiting devices 24 and 25. This is that the oscillating signal supplied to the series-resonance circuit 48, 50 from the transistors 22 and 23 is a square wave oscillator signal. The circuit 10 further includes two de-coupling capacitors 34 and 38.

The circuit 10 operates in the following manner. As mentioned above, the oscillator is initially started by means of the diac 32, the capacitor 36, the diode 46 and the resistors 40 and 42 so that the oscillator starts transferring electric energy through the series-resonance circuit 48, 50 to the parallel-resonance circuit 52, 54. The parallel-resonance circuit 52, 54 accumulates the energy transferred thereto, consequently, the voltage across the capacitor 52 increases. As mentioned above, the power MOS-FET switches 22 and 23 are operated so as to generate a square wave oscillator signal, which results in a maximum power being transferred from the power supply rails 18 and 20 to the series-resonance circuit 48, 50 through the switches 22 and 23. The series-resonance circuit 48, 50, the frequency of resonance of which is lower than the frequency of resonance of the parallel-resonance circuit 52, 54 provides a band-pass filtering of the square wave oscillator signal. The signal supplied through the wire 56 is consequently a band-pass filtered signal, i.e. a basically sinusoidal signal, which is of the utmost importance as to limiting of the radiation of radio frequency noise from the circuit and further from the lamp 12.

The lamp 12 constitutes, in its off-state, an extremely high impedance and does not, in its off-state provide any loading to the parallel-resonance circuit 52, 54. The signal supplied through the wire 56 and further through the starting electrode 14 helps the lamp 12 to start or initiate as the electrode is heated. However, the main ignition is affected by the extremely high energy which is accumulated in the parallel-resonance circuit 52, 54, while the lamp 12 is in its off-state. When a certain threshold voltage, characteristic of the gas discharge lamp 12 is increased, the gas discharge lamp is ignited. As mentioned above, the energy accumulated in the parallel-resonance circuit 52, 54 results in a generation of an increasing voltage across the capacitor 52. It further results in the voltage across the capacitor 52 exceeding the threshold voltage characteristic of the gas discharge lamp 12 after a relatively short period of accumulating energy in the parallel-resonance circuit 52, 54. When the gas discharge lamp starts conducting or ignites, the load of the gas discharge lamp decreases to a fairly low resistive impedance of approximately 100 Ω, and the high energy stored in the parallel-resonance circuit 52, 54 is consequently discharged through the gas discharge lamp 12. This ensures that the gas discharge lamp 12, which has just been started, continues to be conductive and is consequently positively switched from its off-state to its on-state.

After the gas discharge lamp 12 has been started, the oscillation of the oscillator of the circuit 10 is maintained by the parallel-resonance circuit 52, 54, which controls the generation of the oscillator signal to the gas discharge lamp 12. The parallel-resonance circuit 52, 54 further has a stabilizing effect on the gas discharge lamp 12, so that the light emitted is perceived as a stable light emission. Furthermore, the series configuration of the series-resonance circuit 48, 50 and the parallel-resonance circuit 52, 54 makes the circuit independent on any ripple on the DC supply, and of any variation of the voltage of the DC supply. Still further, the voltages across the gas discharge lamp 12 are automatically stabilized at the operational voltage of the gas discharge lamp since any tendency of the gas discharge lamp 12 to turn off is counter-acted by the parallel-resonance circuit 52, 54. Thus, in case where the gas discharge lamp 12 is about to shift from its on-state to its off-state, which results in a radical increase of the load or impedance of the gas discharge lamp, the energy transferred from the oscillator through the series-resonance circuit 48, 50 to the parallel connection of the gas discharge lamp and the parallel-resonance circuit 52, 54 is accumulated in the parallel-resonance circuit 52, 54. This results in an increased voltage being applied to the gas discharge lamp 12 whereupon the gas discharge lamp 12 shifts back from its off-state to its on-state.

Two additional points are to be emphasized. First, the series configuration of the series-resonance circuit 48, 50 and the parallel-resonance circuit 52, 54 is established through the starting electrode 14 of the gas discharge lamp 12. Therefore, in case where the gas discharge lamp 12 is removed from its sockets (not shown in FIG. 1) connected to the wires 56, 58 and 60, the connection between the series-resonance circuit 48, 50 and the parallel-resonance circuit 52, 54 is interrupted. Consequently, the transfer of energy from the oscillator to the parallel-resonance circuit 52, 54 through the series-resonance circuit 48, 50 is also interrupted, and an extremely high starting voltage accumulated across the capacitor 52 is eliminated. This could otherwise be hazardous to a person replacing the gas discharge lamp 12 with a new gas discharge lamp or simply remounting the gas discharge lamp after e.g. cleaning. Second, the feed-back of the entire circuit is brought about at the parallel-resonance circuit 52, 54. This results in a highly reliable controlling of the oscillator without any risk of overshoot of the oscillator signal supplied from the oscillator and further any risk of rendering the power MOS-FETs 22 and 23 conductive at the same time which might else result in excessive current being conducted through the MOS-FETs. The control signal or the feed-back signal supplied to the oscillator is a true measure of the oscillator signal generated in the high Q parallel-resonance circuit 52, 54.

In FIG. 2, a perspective view of a presently preferred integral embodiment of the circuit according to the invention is shown. The circuit is housed in a metallic housing designated the reference numeral 70 in its entirety. The housing 70 comprises a base housing part 76 and a cover housing part 77. In the base housing part 76, a printed circuit board 74 is arranged, on which the components of the electronic circuit 10 is arranged. Thus, in FIG. 2, the power MOS-FETs 22 and 23, the transformer 30, the capacitors 36 and 38, the diode 46, the capacitors 48 and 52 and the inductors 50 and 54 are shown arranged on the printed circuit board 74. The terminals 78 and 79, which are accessible from the outside of the housing 70, are also shown in FIG. 2. The printed circuit tracks, not shown in FIG. 2, of the printed circuit board 74, and the electronic components are insulated in relation to the metallic housing parts 76 and 77 by means of a plastics foil 80. On top of the inductors 50 and 54, insulating pads 82 and 81, respectively, are arranged. From the lower side surface of the housing 70, a socket 72 of conventional configuration protrudes. The socket 72 constitutes the connections 56 and 58 shown in FIG. 1 and is supported by the circuit board 74 and connected in electrically conductive connection with circuit tracks thereof.

The integral embodiment shown in FIG. 2 offers a distinct advantage, which will be evident from FIG. 4, viz. that apart from the wire connections 18 and 20 to the terminals 78 and 79, only a single wire connection corresponding to the wire 60 shown in FIG. 1 is required for establishing connection to the circuit and further to the gas discharge lamp connected thereto. In case a plurality of gas discharge lamps and a plurality of circuits are arranged in a lighting fitting or luminaire, only the terminals 78 and 79 of the housing 70 are to be connected in parallel to a common DC power supply, and a single wire 60 is to be connected from one of the terminals 79 of one of the housings 70 to the individual electrodes 16 of the gas discharge lamps 12, as is evident from FIG. 3.

In FIG. 3, a diagrammatical view of a circuitry of a lighting fitting or luminaire including a plurality of gas discharge lamps and a plurality of circuits according to the invention is shown. The individual gas discharge lamps are connected to the corresponding circuits 10 through the wires 56 and 58 and are connected to a terminal corresponding to the terminal 79, shown in FIGS. 1 and 2, or one of the circuits 10 through the wire 60. The DC power input terminals 78 and 79 of the circuits 10 are connected in parallel to the DC power rails 18 and 20, which are further connected to a common DC power supply, which is constituted by a bridge rectifier 92, which may be connected to an AC power supply, such as a 110 V, 220 V or 240 V, 50 Hz or 60 Hz mains supply, through terminals 90 and 91, a stand-by loading resistor 94, a smoothing capacitor 96 and a two-way turn-on switch 98, 99. When the switches 98 and 99 are open, the capacitor 96 is charged through the resistor 94 to a potential defined by the voltage of the AC power supply signal supplied to the rectifier 92, as is well known in the art. When the switches 98 and 99 are activated, the resistor 94 is short-circuited, and the positive DC supply rail 18 is connected through the switch 99 to the anode of the capacitor 96 and further to the anode of the bridge rectifier 92. The resistor 94, the capacitor 96 and the two-way switch 98, 99 serve the purpose of limiting the loading of the bridge-rectifier 92 and further of the AC power supply when the entire lighting fitting or luminaire is turned on.

In FIG. 4, a lighting fitting or luminaire designated the refrence numeral 100 is shown. The lighting fitting or luminaire 100 is a lighting fitting of a solarium. The gas discharge lamps 12, which are UV-luminescence tubes, are arranged on the lower side surface of the housing 100. At the right-hand end of the housing 100, the ends of the individual UV-luminescence tubes are received in a conventional luminescence tube socket, to which a single wire 60 is connected in accordance with the wiring scheme of FIG. 3. In the left-hand end of the housing 100, the ends of the individual UV-luminescence tubes 12 are received in respective sockets 72 of the housings 70 shown in greater detail in FIG. 2. The individual housings 70 constituting the above described integral embodiment of the circuit according to the invention are connected through their terminals 78 and 79 shown in FIG. 2 to the DC power supply rails 18 and 20 in a parallel configuration. From FIG. 4 it is evident that the wiring of the entire assembly of lighting fitting is very simple, well arranged and well planned. This provides a distinct advantage as compared to the conventional lighting fittings or assemblies for use in solaria. In the conventional embodiment of a solarium, the UV-luminescence tubes are connected to their ballast and starter circuits through a total of four wires each.

In FIGS. 5*a* and 5*b*, a single circuit 10 according to the invention is shown connected to two and four gas discharge lamps, respectively. As is conventional in the art, the circuits for starting and operating the gas discharge lamp is constructed to a certain power load, e.g. to a 100 W load. Therefore, a single 100 W circuit according to the invention may start and operate e.g. two 50 W gas discharge lamps as is shown in FIG. 5*a* or four 25 W gas discharge lamps as shown in FIG. 5*b*. As is evident from FIG. 5*a*, the two gas discharge lamps 12 are connected in a series configuration through the wires 56 and 58 and further a wire 103 interconnecting the starter electrodes of the gas discharge lamps 12 to which starter electrodes the wires 56 and 58 are connected. The starter electrodes at the opposite ends of the gas discharge lamps 12 are connected to a bifilarly wound coil 102 through two wires 104 and 105. The bifilarly wound coil 102 serves the purpose of starting and operating the gas discharge lamps 12 simultaneously. In case the wires 104 and 105 were simply connected to the negative power supply rail 20, only one of the gas discharge lamps 12, which are most often not completely identical to each other in respect of load characteristics, would presumably be started and therefore operated at an excessive load. However, when one of the gas discharge lamps 12 is ignited or started, the bifilarly wound coil 102 increase the voltage across the other gas discharge lamp which is consequently also started. Furthermore, the coil 102 stabilizes the operation of the two gas discharge lamps 12 in that any drift of one of the two tubes or lamps, which could cause the other lamp or tube to be turned off, is compensated for by the bifilarly wound coil. This increases the voltage across the lamp or tube, which is about to be turned off, and consequently forces the lamp or tube back into operation or steadily maintains the lamps or tubes in their on-state.

In FIG. 5*b* the gas discharge lamps or tubes 12 are also connected in a series configuration through the wires 56 and 58 and further through wires 113, 114 and 115. Apart from the bifilarly wound coil 102 and the wires 104 and 105, which serve the purpose of splitting the four lamps or tubes into two sets of each two lamps or tubes, the assembly includes two additional bifilarly wound coils 106 and 108 corresponding to the coil 102 and wires 109, 110, 111 and 112. These are for establishing connection between the coils 106 and 108 and the individual lamps or tubes 12. Basically, the four lamp embodiment shown in FIG. 5*b* functions in the same manner as the embodiment shown in FIG. 5*a*.

In FIG. 6, a perspective and exploded view of a lighting fitting or luminaire of the wiring scheme configuration of FIG. 5*a* is shown. In FIG. 6, the gas discharge lamps or tubes 12 are received in separate sockets 121, which are mounted in a lighting fitting or luminaire housing 120. In the housing 120, the electronic circuit 10 according to the invention, the DC power supply capacitor 96 and the bifilarly wound coil 102 are also contained. In an alternative embodiment, the DC power supply capacitor 96 and the bridge rectifier, not shown in FIG. 6, are also housed in the housing containing the circuit 10.

In FIG. 7, a slightly modified embodiment relative to the embodiment of the circuit 10 shown in FIG. 1 is shown designated the reference numeral 10' in its entirety. The circuit 10' basically includes the same circuit configuration and the same components as shown in FIG. 1 and described above. The circuit 10' shown in FIG. 7, however, differs from the circuit 10 shown in FIG. 1 in the following aspects: Firstly, the smoothing input capacitor 34, the decoupling capacitor 38 and the resistor 42 are omitted. Secondly, the power MOS-FET switch 23 is provided with a current limiting circuit constituted by a thyristor 126 and a resistor 144 corresponding to the thyristor 26 and the resistor 44, respectively, connected to the power MOS-FET switch 22. Thirdly, the order of the capacitor 48 and the inductor 50 of the series-resonance circuit is changed. Fourthly, the circuit 10' shown in FIG. 7 is provided with a resistor 132 connected in series with the diode 46, the node of the cathode of the diode 46 and one of the terminals of the resistor 132 being connected to a terminal 141, the importance of which will be described below. A resistor 134 is further provided interconnecting a further terminal 142 also to be described in detail below and the node of the diac 32 and the gate of the power MOS-FET switch 23. In FIG. 7, the wires 56, 58 and 60 are further connected to terminals 138, 139 and 140, respectively, of a multi-pole terminal block or socket 136.

Fifthly, in the lower part of FIG. 7, a shut-down circuit is provided which shut-down circuit is included in a dotted line boundary block and serves the purpose of determining if the voltage generated by the parallel resonance-circuits 52, 54 and supplied to the terminal 139 through the wire 58 exceeds a predetermined threshold for a period of time which exceeds a predetermined period of time. This corresponds to the situation in which the circuit 10' for starting and operating the gas discharge lamp connected to the circuit 10' through the terminals 138, 139 and 140 does not ignite or is not able to be shifted from its off-state to its on-state, e.g. because of the fact that the gas discharge lamp has been burned out or that wires have been broken or disconnected. The shut-down circuit serves two purposes: Firstly, the purpose of protecting a person replacing the gas discharge lamp which does not ignite from exposure to electric shock, and secondly, the purpose of protecting the entire circuit 10' for starting and operating the gas discharge lamp from excessive currents and voltages.

The shut-down circuit comprises the following components: a resistor 146, a diode 147, a diode 148, a resistor 149, a capacitor 150, a resistor 151, a capacitor 152, a resistor 153, a diac 154, a resistor 155, a capacitor 156, a capacitor 157, a thyristor 158, and a thyristor 128. Basically, the diodes 147 and 148 serve the purpose of rectifying the high frequency altering voltage supplied to the gas discharge tube from the parallel-resonance circuits 52, 54, which voltage is generated across the terminals 139 and 140. The rectified voltage is charged on the capacitor 150, the charging time constant being determined by the resistor 146 and the capacitor 150. The resistor 151 and the capacitor 152 constitute a low-pass filter for filtering out any excessive high voltage spikes.

Provided the voltage across the terminals 138 and 140 has exceeded a predetermined threshold determined by the diac for a period of time exceeding the time required for charging the capacitor 152 to said threshold, the diac 154 fires and consequently turns on the thyristor 158 which draws current from the terminal 78 through the resistor 153 and turns on the thyristor 128 which is connected in parallel with the thyristor 126 and is maintained in a conducting state until the entire circuit has been shut off, due to the current supplied to the thyristor through the resistor 163, so that the power MOS-FET 23 has its gate short-circuited to the terminal 79 through the thyristor 128.

In FIG. 8, a slightly modified configuration of the the series configuration of the series-resonance circuits 48, 50 and the parallel-resonance circuit characteristic of the present invention is shown. In FIG. 8, the parallel-resonance circuit is constituted by a secondary winding of a transformer 160 and two capacitors 161 and 162 which are connected between the terminals 138 and 139 and between the terminals 139 and 140, respectively. The primary winding of the transformer 160 is connected in series with the series-resonance circuit 48, 50 across the output terminals of the half-bridge oscillator. By the provision of the transformer 160, the gas discharge lamp connected to the circuit through the terminals 138, 139 and 140 is galvanically separated from the circuit for starting and operating the gas discharge lamp and further from the DC power supply which is still further connected to the mains supply, as will be described below, which DC power supply supplies DC power to the circuit for starting and operating the gas discharge lamp. Consequently, the transformer 160 galvanically separates the terminals 138, 139 and 140 and, consequently, the gas discharge lamp from the mains supply. The capacitors 161 and 162 provide a voltage division of the voltage generated across the terminals 138 an 140. Consequently, a voltage is generated across the gas discharge lamp connected thereto so as to generate a small voltage across the capacitor and consequently the starting electrode of the gas discharge lamp connected to the terminals 138 and 139 from the high ignition voltage generated across the terminals 138 and 140. Furthermore, the transformer coupling shown in FIG. 8 renders it possible to connect a number of gas discharge lamps to a single circuit for starting and operating the gas discharge lamps by means of individual transformers or separate secondary windings of the transformer 160.

As indicated above, the above described circuits 10 and 10' shown in FIGS. 1 and 7, respectively, may be supplied from any appropriate DC power supply, e.g. the DC power supply shown in the left hand side of FIG. 3 which may constitute a DC power supply common to a plurality of circuits for starting and operating individual gas discharge lamps or may constitute a DC power supply for a single circuit for starting and operating a gas discharge lamp. With reference to FIGS. 9 and 10 a stabilized, switch-mode DC power supply and an unstabilized DC power supply, respectively, for the above described circuit 10' shown in FIG. 7 is to be described.

The switch-mode DC power supply shown in FIG. 9 is designated the reference numeral 180 in its entirety. For providing electrical connection to the mains supply, the switch-mode power supply circuit 180 is provided with an AC mains supply plug or terminal block 163 comprising a live terminal 164 and a neutral terminal 165. The live terminal 164 is connected to a fuse 166 and further through a thermostatically controlled switch 167 to a capacitor 168 which is also connected to the neutral terminal 165. The capacitor 168 is consequently connected across the terminals 164 and 165 and further across a radio frequency interference filter 169 comprising two windings on a common core. Across the radio frequency interference filter 169, a voltage dependent resistor 170 and a full-wave bridge rectifier 171 are connected. Across the positive and negative terminals of the full-wave bridge rectifier 171, which serves the purpose of rectifying the mains voltage supplied to the full-wave bridge rectifier 171 from the terminals 164 and 165, a smoothing and radio frequency interference suppression capacitor 172 is connected.

The negative terminal of the full-wave bridge rectifier 171 is connected to the above-mentioned terminal 79, and the positive terminal of the full-wave bridge rectifier 171 is connected to the above described terminal 78 through an inductor 173 and a diode 174. The switch-mode DC power supply circuit 180 centrally comprises an integrated circuit 175 of the type TDA 4814A manufactured by the company Siemens AG. As far as the integrated electronic circuit 175 of the type TDA 4814A is concerned, reference is made to the descriptions and application notes from Siemens AG, referring to the integrated circuit of the type TDA 4814A.

From the positive terminal of the full-wave bridge rectifier 171 a reference voltage is derived by means of a resistive divider network comprising three resistors 176, 177 and 178 and further a smoothing capacitor 179, which reference voltage is supplied to the multiplier reference input terminal 11 of the integrated circuit 175. The integrated circuit 175 has its terminal 1 connected to the negative terminal or ground terminal 79. The series-resonance circuit comprising a resistor 181 and a capacitor 182 is connected between the terminals 12 and 13 of the integrated circuit 175, which terminal 12 of the integrated circuit 175 is further connected to the terminal 78 of the DC switch-mode power supply circuit 180 through two resistors 183 and 184. Across the terminals 78 and 79, a capacitor 185 is arranged which capacitor basically corresponds to the capacitor 34 shown in FIG. 1.

The node of the resistors 183 and 184 is further connected to the terminal 79 through a resistor 186. The switch-mode DC power supply circuit 180 further includes a power MOS-FET switch 187, the gate of which is connected to the terminal 2 of the integrated electronic circuit 175, the drain of which is connected to the node of the inductor 173 and the anode of the diode 174, and the source of which is further connected to the terminal 4 of the integrated electronic circuit 175. The terminal 4 is further connected to the ground terminal 79 through a resistor 188. The switch-mode DC power supply circuit 180 further comprises a smoothing capacitor 189, two diodes 190, 191, which constitute a switch-mode circuit configuration, and a capacitor 192 which is connected to the terminal 141. The terminal 142 is connected to the terminal 14 of the integrated electronic circuit 175. As is evident from FIG. 9, the cathode of the diode 191 is connected to the terminal 3 of the integrated electronic circuit 175.

It is to be realized that the integrated electronic circuit 175 is not turned on until the circuit 10' shown in FIG. 7 connected to the switch-mode DC power supply circuit 180 through the terminals 78, 79, 141 and 142 has started its oscillation. As is evident from FIG. 9, the internal DC input terminal 3 of the integrated electronic circuit 75 is connected to the capacitor 189. The capacitor 189 is loaded through the diodes 190 and 191 and further through the capacitor 192 from the terminal 141 connected to the circuit 10' for starting and operating the gas discharge lamp. The voltage supplied from the circuit 10' to the terminal 141 is the oscillator signal generated by the power MOS-FET switches 22 and 23 which oscillator signal is transferred through the current limiting device or inductor 50 to the parallel-resonance circuits 52, 54 in accordance with the teaching of the present invention.

As is evident from FIGS. 7 and 9, the terminal 14 of the integrated electronic circuit 175 is connected to the gate of the power MOS-FET switch 23 and, consequently, constitutes a feed back loop from the oscillator of the circuit 10' to the detector input terminal 14 of the integrated electronic circuit 175. On the basis of the comparison of the voltage present on the terminal 11 of the integrated electronic circuit 175 which voltage respresents the mains supply voltage, and the voltage present of the terminal 12 of the integrated electronic circuit 175 which voltage represents the voltage across the capacitor 185, the flip-flop of the integrated electronic circuit 175 switches the power MOS-FET switch 187 on and off in order to draw current from the positive terminal of the full-wave bridge rectifier 171 so as to draw current through the inductor 173. This occurs when the power MOS-FET switch 187 is turned on which current results in the accumulation of energy in the inductor. When the power MOS-FET switch 187 is turned off, the energy stored in the inductor is transferred to the capacitor 185 through the diode 174. By this operation the voltage across the capacitor may be increased above the voltage across the capacitor 172. This operation is also known as "booster" operation. The circuit 180 shown in FIG. 9 provides a very low reactive loading of the mains supply and further a high power factor in that the current drawn from the mains supply is in phase with the mains supply voltage.

In FIG. 10, an alternative DC power supply circuit designated the reference numeral 180' is shown. The DC power supply circuit 180' shown in FIG. 10 is basically an unstabilized DC power supply circuit. This differs from the above described stabilized or switch-mode power supply circuit 180 shown in FIG. 9 in that the components 172–178 and the components 181–192 are omitted, and further in that a further capacitor 198 and a further radio frequency interference filter 199 are interconnected between the radio frequency interference filter 169 and the voltage dependent resistor 170 in order to further suppress noise on the mains supply generated by the circuit 180' and further the circuit 10' shown in FIG. 7. The circuit 180' shown in FIG. 10 further comprises a resistor 193 which is connected between the positive terminal of the full-wave bridge rectifier 171 and the terminal 78 constituting a resistive load to the full-wave bridge rectifier during the starting of the circuit 10', a triac 194, which has it gate terminal connected through a resistor 195 to the terminal 141 and which is consequently turned on like the above described integerated electronic circuit 175 after the circuite 10' has started its oscillating operation by which turn-on of the triac 194 the load resistor 193 is short-circuited. Across the terminals 78 and 79 two smoothing capacitors 196 and 197 are connected. It is to be realized that the resistor 193, the capacitors 196 and 197 and the triac 194 basically serve the same purpose as the resistor 94, the capacitor 96 and the switches 98, 99 of the power supply circuit shown in FIG. 3.

In FIG. 11, a perspective view of an implementation of the electronic circuits 10' and 180 shown in FIG. 7 and in FIG. 9, respectively, is shown. In FIG. 11 the components: 48, 50, 52, 54, 23, 35, 126, 202, 185, 175, 173, 172, 170, 189, 168, 167, 166 and 163 are shown arranged on a printed circuit board 200. In the embodiment shown in FIG. 11 the printed circuit board 200 is constituted by a single-sided printed circuit board of a conventional structure. As is evident from FIG. 11, all the components of the circuits 10' and 180, shown in FIG. 7 and in FIG. 9, respectively, are mounted on the printed circuit board 200. Thus, the assembly constituted by the printed circuit board 200 and the components arranged thereon are adapted to be arranged in a housing which may be constituted by an aluminum housing or preferably a housing of an insulating material such as a housing cast from a strong plastics material such as the material LEXAN, from which housing the multipole terminals 136 and 163 protrude for providing access, and in which housing the above-mentioned assembly is secured and maintained in position by a moulding compound filling the entire space of the housing. The moulding compound is preferably a heat conducting compound as is well-known in the art for thermally stabilizing the entire circuitry and further for conducting heat to the outer side surfaces of the housing. The outer side surfaces of the housing may further be provided with heat radiating fins or ribs for increasing the surface area of the housing. As is evident from FIG. 11, the power MOS-FETs 22, 23 and 187 are mounted on heat sinks 201, 202 and 203, respectively.

EXAMPLE 1

An 100 W implementation of the circuit shown in FIG. 1 was constructed from the following components:

The capacitor 34 was constituted by a 2.2 μF/400 V capacitor, the resistor 40 was a 1 MΩ resistor, the resistor 42 was a 330 kΩ resistor, the capacitor 38 was a 1 nF capacitor, the capacitor 36 was a 100 nF capacitor, the diode 40 was a diode of the type 1N4847, the diac 32 was a diac of the type 1N5758, the power MOS-FETs 22 and 23 were power MOS-FETs BUZ 76, the peak-limiting devices 24, 25 were transils of the type BZW12B, the resistor 44 was a 0.25 Ω resistor, the thyristor 26 was 2N 5061 thyristor, the resistors 28 and 29 were 100 Ω resistors, the capacitor 48 of the series-resonance circuit was a 100 nF/1200 V capacitor, the inductor 50 of the series-resonance circuit was a 600 μH inductor constitued by 60.5 windings of wire on a ferrite coil core, the capacitor 52 of the parallel-resonance circuit was a 47 nF/1200 V capacitor, the inductor 54 of the parallel-resonance circuit was a 270 μH inductor constituted by 43.5 windings of wire on a ferrite coil core, and the transformer 30 was wound on a ferrite ring comprising a single primary winding and two secondary windings including 20 windings each.

EXAMPLE 2

220 V/50 Hz, 100 W and a 240 V/50 Hz, 100 W implementations of a combination of the circuits shown in FIGS. 7 and 10 were constructed from the following components:

The fuse 166 was a 3 A fuse, the thermostatically controlled switch 167 was a 85° C., 5% temperature protector, the terminal block 163 was a 2-pole terminal block, min 10 A, the terminal block 136 was a 3-pole terminal block, min. 10 A, the capacitors 168 and 198 were 100 nF, min 250 VAC capacitors, the radio frequency interference filters 169 and 199 were RFI-filters, min. 1 A, the voltage dependent resistor 170 was a VDR, 250 V, the full-wave bridge rectifier 171 was a 1 A, min. 600 V (220 V/50 Hz) or 700 V (240 V/50 Hz) rectifier, the resistor 193 was a 100 Ω, Wire Wound, 4 W resistor, the resistor 195 was a 10 Ω, 1 W, 5% resistor connected in series with a 1 nF, 400 V capacitor, the capacitors 196 and 197 were 47 μF, 350 V electrolytic capacitors, min 105° C., the triac 194 was a 400 V, min. 10 A triac, the resistors 146 and 149 were 1 MΩ, metal film, 0.5 W, 1% resistors, the resistor 132 was a short-circuit connection, the resistor 134 was omitted, the resistor 153 was a 33 kΩ, min. 2.5 W, 5% resistor, the resistor 155 was a 10 kΩ, metal film, min. 0.5 W, 1% resistor, the capacitor 152 was a 220 nF, 63 V capacitor, the resistors 40 and 151 were 5.6 MΩ metal film, min. 0.5 W, 1% resistors, the capacitors 36, 150, 156 and 157 were 100 nF 163 V capacitors, the diodes 46, 147 and 148 were diodes of the type 1N4847, the diacs 32 and 154 were 32 V, 10% diacs, the power MOS-FETs 22 and 23 were 400 V power MOS-FETs, min. 3 A, max. 1.5 Ω, the peak-limiting devices 24, 25 were 15 V transils, the resistors 44 and 144 were 0.18 Ω resistors, metal film, min. 0.5 W, 1%, the thyristors 26, 120, 126 and 158 were min. 400 V, lh<3 mA, 630<Vt<680 mV thyristors, the resistors 28 and 29 were 100 Ω metal film, min. 0.5 W, 1% resistors, the capacitor 48 of the series-resonance circuit was a 100 nF, min. 400 V polyester, 10% capacitor, the inductor 50 of the series-resonance circuit was a 600 μH inductor, min. 2 A, Q>200, the capacitor 52 of the parallel-resonance circuit was a 47 nF, min. 100 V polyester, 5% capacitor, the inductor 54 of the parallel-resonance circuit was a 270 μH inductor, min. 4 A, Q>200, the transformer 30 was wound on a ferrite ring comprising a single primary winding and two secondary windings including 20 windings each.

EXAMPLE 3

120 V/60 Hz, 33 W, 120 V/60 Hz, 100 W and 220 V/50 Hz, 100 W implementaions of combinations of the circuits shown in FIGS. 7 and 9 (for 120 V/60 Hz, 33 W modified in accordance with FIG. 8) were constructed from the following components:

The terminal block 136 was a 3-pole terminal block, min. 10 A, the terminal block 163 was a 2-pole terminal block, min. 10 A, the fuse 166 was a 3 A fuse, the thermostatically controlled switch 167 was a 85° C., 5% temperature protector, the resistors 40 and 151 were 5.6 MΩ resistors, the capacitors 36, 150, 156, 157 and 179 were 100 nF capacitors, min 25 V, the diodes 46, 147 and 148, 190 and 191 were diodes of the type 1N4847, the diacs 32 and 154 were 32 V, 10% diacs, the power MOS-FETs 22, 23 and 187 were 400 V power MOS-FETs, min. 3 A, max. 1.5 Ω(for 220 V/50 Hz, the power MOS-FET 187 was a 500 V power MOS-FET, min. 2 A, max. 1.5 Ω), the peak-limiting devices 24, 25 were 15 V transils, the resistors 44 and 144 were 0.18 Ω resistors, the thyristors 26, 126, 128 and 158 were min. 400 V, lh<3 mA, 630 mm<Vt<680 mV thyristors, the resistors 28 and 29 were 100 Ω resistors, the capacitor 168 was a 100 nF, min. 250 VAC capacitor, the radio frequency interference filter 169 was a RFI-filter, min. 1 A (120 V, 60 Hz, 100 W), or min. 0.5 A (120 V, 60 Hz, 33 W and 220 V, 50 Hz, 100 W), the voltage dependent resistor 170 was a VDR, 250 V, the full-wave bridge rectifier 171 was a 1 A, min. 600 V (120 V, 60 Hz) or 700 V (220 V, 50 Hz) rectifier, the capacitor 172 was a 2.2 μF, 400 V polyesther capacitor, the inductor 173 was a 1 mH, min. 2 A inductor (120 V/60 Hz), or a 2 mH, min. 1 A inductor (220 V/50 Hz), the diode 174 was a fast, min. 1 A, min. 400 V, max. 50 nS diode, the integrated electronic circuit 175 was a TDA 4814A (Siemens AG), the resistor 153 was a 33 kΩ, metal film, min. 2.5 W, 5% resistor, the resistors 132 and 177 were 10 Ω resistors, the resistor 134 was a 100 kΩ resistor, the resistors 146 and 149 were 1 MΩ resistors, the resistors 155 and 178 were 10 kΩ resistors, the capacitors 152, 179 and 182 were 220 nF, min. 63 V (100 W) or min. 25 V (33 W) capacitors, the resistors 181, 183 and 186 were 2 kΩ resistors, the resistor 184 was a 301 kΩ resistor (for 120 V/60 Hz, 53 W and 100 W) or a 330 kΩresistor (for 220 V/50 Hz, 100 W), the capacitor 185 was a 47 μF, 350 V, electrolytic capacitor, min. 105° C., the resistor 188 was a 22 Ω resistor (for 120 V/60 Hz, 33 W and 100 W) or a 56 Ω resistor (for 220 V/50 Hz, 100 W), the capacitor 189 was a 100 μF, 16 V, electrolytic capacitor, min. 105° C., the capacitor 192 was a 1 nF, 400 V capacitor, the capacitor 48 of the series-resonance circuit was a 100 nF, min. 250 V (33 W) or min. 400 V (100 W) capacitor, the inductor 50 of the series-resonance circuit was a 600 μH inductor, min. 2 A, Q>200 (100 W) or a 900 μH, min. 1 A, Q>200 (33 W), the capacitor 52 or the capacitor 102 of the 120 V/60 Hz, 33 W implementation of the parallel-resonance circuit was a 47 nF, min. 1000 V, 5% polyester capacitor, the capacitor 161 of the 120 V/60 Hz, 33 W implementation was a 680 nF, min. 25 V capacitor, the inductor 54 of the parallel-resonance circuit was a 270 μH inductor, min. 4 A, Q>200 (100 W) or a 500 μH, min 1 A, Q>200 (33 W), and the transformer 30 was wound on a ferrite ring comprising a single primary winding and two secondary windings including 20 windings each.

In the above examples 1, 2 and 3, the resistors were min. 0.5 W, 1% metal film resistors if not otherwise specified.

The circuit of the above examples had the following characteristics. The frequency resonance of the parallel-resonance circuit 52, 54 was 40–45 kHz, the frequency of resonance of the series-resonance circuit 48, 50 was 20–25 kHz. The ignition voltage generated by the parallel-resonance circuit 52, 54 was approximately 2 kV. The operational voltage generated by the circuit and supplied to the gas discharge lamp was approx. 100–125 V dependent on the age of the gas discharge lamp, however independent of the DC supply voltage varying between 270 V and 310 V. The oscillator frequency was basically determined by the frequency of resonance of the parallel-resonance circuit 52, 54, and the frequency of resonance and further the oscillator frequency was basically constant during start, operation and throughout the operational time.

Apart from the above described advantages as to the positive starting of the luminescence tube connected to the circuit, the avoided light flickering, the low radio frequency emission, the well planned and well arranged wire connection, the embodiment of the above example has further disclosed the following advantages. The power requirements of the lighting fitting is 25–30% lower than the power requirements of a conventinal lighting fitting including a passive ballast and starter circuit and the life-time of the gas discharge lamp or the luminescence tube powered by the circuit according to the invention seems to be increased at least by a factor of 1.5–2. These advantages are believed to have their origin in the high frequency operation of the gas discharge lamp and the fact that the gas discharge lamp, which is powered by the circuit according to the invention, is supplied with a constant power signal due to the series configuration of the series-resonance circuit and the parallel-resonance circuit, across which the gas discharge lamp or luminescence tube is connected.

Although the invention has been described with reference to a specific embodiment, it is obvious to the skilled art worker that numerous modifications may easily be deduced from the teachings of the present invention. Thus, the oscillator of the circuit of the present invention may be modified into a full-bridge oscillator by connecting the starter electrode 16 shown in FIG. 1 to a circuit similar to the circuit 10 shown in FIG. 1. Such modifications are to be considered covered by the scope of the appending claims. Furthermore, although the invention has been described with reference to a particular application of the circuit of the present invention, viz. in connection with luminescence tubes, it is, however, believed that the circuit of the present invention may also be adapted to start and operate arc lamps and halide lamps and consequently any discharge lamp of the above described generic type, which are distinguishable from incandescent lamps.

I claim:

1. A circuit for starting and operating a gas discharge lamp, comprising:

a series-resonance circuit comprising a first capacitator and a first inductor;

a parallel-resonance circuit, comprising a second capacitor and a second inductor, said series-resonance circuit having a resonance frequency lower than that of said parallel-resonance circuit; and oscillator means, connected to said series-resonance circuit, for generating and supplying an oscillator signal of a specific oscillator frequency, substantially identical to said resonance frequency of said parallel-resonance circuit, to said gas discharge lamp through said series-resonance circuit, said series-resonance circuit and said parallel-resonance circuit being connected in a series configuration.

2. A circuit as claimed in claim 1, wherein said series-resonance circuit band-pass filters said oscillator signal supplied by said oscillator means.

3. A circuit, as claimed in claims 1 or 2 wherein said series-resonance circuit and said parallel-resonance circuit are connected to each other in said series configuration through a starting electrode of said gas discharge lamp.

4. A circuit, as claimed in claim 1, wherein said oscillator means is supplied with a feed-back oscillator signal for controlling the generation of said oscillator signal, said feed-back oscillator signal being generated by said parallel-resonance circuit.

5. A circuit, as claimed in claim 1, wherein said oscillator means has two input terminals for connection to a DC power supply for receiving a DC power supply signal and two output terminals for generating and supplying said oscillator signal.

6. A circuit, as claimed in claim 5, further comprising said DC power supply and a rectifier means for connection to a mains supply.

7. A circuit, as claimed in claim 6, wherein said DC power supply is constituted by a switch-mode power supply.

8. A circuit, as claimed in claim 1, further comprising a shut-down circuit connected in parallel with said gas discharge lamp for detecting whether the voltage supplied to said gas discharge lamp exceeds a predetermined threshold for a period of time exceeding a predetermined period of time and for disabling said circuit for starting and operating said gas discharge lamp in case said voltage exceeds said threshold for a period of time exceeding said predetermined period of time.

9. A circuit, as claimed in claim 1, wherein said oscillator means is supplied with a feed-back oscillator signal for controlling the generation of said oscillator signal, said feed-back oscillator signal being generated by said parallel-resonance circuit and said oscillator means generates and supplies a square wave oscillator signal.

10. A circuit as claimed in claim 9, wherein said series-resonance circuit and parallel-resonance circuit are connected to each other in said series configuration across output terminals of the oscillator means.

11. A circuit for starting and operating a gas discharge lamp, comprising:

a series-resonance circuit comprising a first capacitor and a first inductor;

a second capacitor;

oscillator means connected to said series-resonance circuit, including a transformer having a primary winding and a secondary winding, said primary winding of said transformer being connected in a series configuration with said series-resonance circuit, and said secondary winding of said transformer being connected in parallel with said second capacitor constituting a parallel-resonance circuit having a frequency of resonance lower than that of said series-resonance circuit, said oscillator means generating and supplying an oscillator signal, of a frequency substantially identical to said resonance frequency of said parallel-resonance circuit, to said gas discharge lamp.

12. A circuit, as claimed in claim 11, wherein said series-resonance circuit band pass filters said oscillator signal supplied by said oscillator means.

13. A circuit for starting and operating a gas discharge lamp, comprising:

series-resonance circuit comprising a first capacitor and a first inductor;

parallel-resonance circuit comprising a second capacitor and a second inductor resonance circuit, said series-resonance circuit having a frequency of resonance lower than that of said parallel-resonance circuit;

oscillator means, connected to said series resonance circuit, constituted by a half-bridge oscillator circuit, for generating and supplying an oscillator signal of a specific oscillator frequency, substantially identical to said resonance frequency of said parallel-resonance circuit, across a hot terminal and a cold terminal constituting a ground terminal of said circuit, to said gas discharge lamp through said series-resonance circuit;

said series-resonance circuit and said parallel-resonance circuit being connected in a series configuration across said hot and cold terminals.

14. A circuit, as claimed in claim 13, wherein said oscillator means constituted by a half-bridge oscillator circuit generates and supplies a square wave oscillator signal.

15. A circuit, as claimed in claim 13, wherein said series-resonance circuit and said parallel-resonance circuit being connected to each other in said series configuration through a starting electrode of said gas discharge lamp.

16. A circuit, as claimed in claim 13, wherein said oscillator means is supplied with a feed-back oscillator signal for controlling the generation of said oscillator signal, said feed-back oscillator signal being generated by said parallel-resonance circuit.

17. A circuit, as claimed in claim 16, wherein said series-resonance circuit and said parallel-resonance circuit are connected to each other in said series configuration through a starting electrode of said gas discharge lamp.

18. A circuit, as claimed in claims 2 or 16, wherein said oscillator means is constituted by a half-bridge oscillator circuit and generates and supplies a square wave oscillator signal.

19. A circuit, as claimed in claim 18, wherein said series resonance circuit and said parallel-resonance circuit are connected to each other in said series configuration through a starting electrode of said gas discharge lamp.

20. A circuit, as claimed in claim 18, wherein said feed-back oscillator signal is generated by a transformer comprising a primary winding and a secondary winding, said primary winding interconnecting said capacitor and said inductor of said parallel-resonance circuit, and said secondary winding being connected to said oscillator means for supplying said feed-back oscillator signal to said oscillator means.

21. A circuit, as claimed in claim 20, wherein said half-bridge oscillator comprises at least two solid state switches each having a control terminal, said transformer comprises two identical secondary windings, and said control terminals are connected to a respective secondary winding of said transformer for receiving a respective feed-back oscillator signal for controlling said switches in a push-pull operation.

22. A circuit, as claimed in claim 21, wherein a peak-limiting circuit is interconnected between each of said control signals and its respective secondary winding for peak-limiting said feed-back oscillator signal supplied to each of said control terminals for controlling said oscillator means to generate a square wave oscillator signal.

* * * * *